United States Patent [19]

Pryor et al.

[11] 4,329,863

[45] May 18, 1982

[54] COOPERATIVE ROLLING PROCESS AND APPARATUS

[75] Inventors: Michael J. Pryor, Woodbridge; Joseph Winter, New Haven, both of Conn.

[73] Assignee: Olin Corporation, New Haven, Conn.

[21] Appl. No.: 167,084

[22] Filed: Jul. 9, 1980

[51] Int. Cl.[3] ..... B21B 1/22; B21B 39/08

[52] U.S. Cl. ..... 72/205; 72/244; 72/366

[58] Field of Search ..... 71/205, 199, 366, 234, 71/241, 237, 244

[56] References Cited

U.S. PATENT DOCUMENTS

| | | | |
|---|---|---|---|
| 3,871,221 | 3/1975 | Vydrin et al. | 72/205 |
| 4,167,107 | 9/1979 | Simmonds | 72/239 |

*Primary Examiner*—Milton S. Mehr

*Attorney, Agent, or Firm*—Paul Weinstein; Howard M. Cohn

[57] ABSTRACT

A rolling mill apparatus and process comprise a plurality of rolls defining a plurality of roll bites defining a gap spacing between adjacent rolls. A fixed gap spacing is employed for at least one roll bite. A floating gap spacing is provided for at least one other roll bite. It is thereby possible to control in a desired manner the amount of thickness reduction at a desired roll bite in a pass through the mill.

33 Claims, 6 Drawing Figures

COOPERATIVE ROLLING PROCESS AND APPARATUS

BACKGROUND OF THE INVENTION

This invention relates to a method and apparatus for reducing the thickness of metal strip. The invention is applicable to a wide range of metals and alloys which are capable of plastic deformation. The apparatus comprises a biased cooperative rolling mill which is adapted to provide increased reduction in thickness of the metal strip per pass as well as increased total reduction between anneals as compared to various prior art approaches. The biasing of the mill enables control of the magnitude of, for example, the final reduction taken in each pass through the mill.

PRIOR ART STATEMENT

Conventionally rolling mills are found with many different configurations, including two high, four high, and cluster mills. With these conventional mills, the total reduction which can be achieved in the metal strip before annealing is required is determined by the roll separating force generated during the rolling operation. This separating force increases from pass to pass as the metal strip becomes work hardened until a maximum limit is reached for the mill. When the separating force reaches a sufficiently high level roll flattening, mill elasticity and strip flow strength are in balance and the mill ceases to make any significant further reductions in the strip thickness. Normally, prior to the strip reaching such a separating force level, further rolling is uneconomic and the strip is annealed to make it softer and thereby reduce the separating force in the next pass through the mill.

It is desired that the percent reduction in thickness per pass and the total reduction which can be taken in the strip by a rolling mill between anneals be as large as possible so as to reduce the need for costly and timeconsuming anneals. Various approaches have been described in the prior art for achieving such increases in available reduction in thickness between anneals. In most of these techniques, a stretching component has been added to the rolling reduction in order to provide increased percentages of reduction.

One such approach comprises contact bend stretch rolling, also known as C-B-S rolling. This technique is illustrated in U.S. Pat. No. 3,238,756 to Coffin, Jr., and in an article by Coffin, Jr., in *The Journal of Metals,* August 1967, pages 14–22. In the C-B-S rolling process plastic bending is provided in conjunction with longitudinal tension and rolling pressure to provide strip or foil thickness reductions. In addition, the rolling mill utilizes a speed ratio between the contact rolls as a means for determining and controlling reduction in place of a conventional rigid roll gap. The strip enters the mill and is threaded around a large roll called the entry contact roll. The strip is then wound about a small floating roll called the bend roll. The bend roll is cradled in the gap between the first large roll and a second large roll called the exit contact roll. The strip is maintained under tension to prevent slipping between the strip and the two contact rolls. The contact rolls are driven at a fixed ratio of surface speed with respect to one another. Reduction occurs at two bite points between the bend roller and the two contact rolls. The reduction is the consequence of the drawing or the stretching of the strip around the small bend roll and the forcing of the strip up into the gap between the two contact rolls where it is squeezed, bent, and rolled sufficiently at both reduction points to match the speed ratio. This apparatus is more fully described in the aforenoted article and patent by Coffin, Jr. The C-B-S process is subject to a number of difficulties as are well known in the art. In particular, it is difficult to lubricate the bend roll and, because of its very small diameter, it rotates at high speeds and tends to heat up and distort. This can cause irregularities in the resultant strip.

Yet another prior art approach comprises a process of rolling metal sheet commonly referred to as "PV" rolling. This process is amply described in U.S. Pat. Nos. 3,709,017 and 3,823,593 both to Vydrin et al. In this process the sheet is rolled between driven rolls of a rolling mill wherein each adjacent roll is rotated in an opposite direction to a next adjacent roll and at a different peripheral speed with respect thereto. The process is effected with a ratio between the peripheral speeds of the rolls controlling the reduction of the strip being rolled. The rate of travel of the delivery end of the strip is equal to the peripheral speed of the driving roll that is rotated at a greater speed. Tension is applied to at least the leading portion of the strip and the application of back tension is also described. The strip may be wrapped in a manner so as to encompass the rolls through an arc of 180° or more.

PV rolling is normally carried out using relatively large diameter rolls of equal diameter. This is so because of the high torque required to drive the rolls. However, by employing large diameter rolls, it is difficult to get a large bite and, therefore, a large reduction in strip thickness per pass. Further, the maximum total reduction achievable with a PV rolling mill between anneals is governed by roll flattening. Roll flattening is a more serious problem with large work rolls than with small work rolls. U.S. Pat. Nos. 3,811,307, 3,871,221, and 3,911,713 all to Vydrin et al. are illustrative of various modifications and improvements which have been made to the PV rolling mill and process.

Many other techniques have been suggested for rolling in a non-conventional manner wherein there is stretching of the strip. Illustrative of such processes and apparatuses are U.S. Pat. Nos. 2,332,796 to Hume, 2,526,296 to Stone, 3,253,445 to Franek, and 3,527,078 to Lawson et al.

One particularly interesting approach is described in U.S. Pat. No. 3,394,574 to Franek et al. In this patent there is described an apparatus and process for rolling strip metal wherein the rolling mill includes first and second back-up rolls arranged in spaced relation for rotation about fixed axes. The back-up rolls are positively driven so that the second has a peripheral speed greater than the first. Disposed between the back-up rolls are first and second freely-rotatable work rollers each of which has a diameter small as compared with that of the back-up rolls. The work rolls are movable bodily relative to the back-up rolls and cooperate one with the other and one with each of the back-up rolls. A stabilizing roller is used to apply pressure to one of the work rollers relative to a back-up roll.

In Franek et al. the strip is moved lengthwise under tension through a path defined by encompassing the strip about the first back-up roll and then in an "S" shape about the work rolls and then emcompassing the strip about the second back-up roll. The work rolls are arranged so that a tension load applied to the strip provides the sole means for producing the rolling load at each of the three nips defined by the respective rolls. In the Franek et al. process and apparatus the rolling load is produced solely by the lengthwise tension in the strip.

Approaches such as C-B-S rolling and the one described in the Franek et al. patent suffer from several drawbacks in addition to those already described above. Since the strip tension is the active element in creating the force between the rolls at each roll nip, it must be relatively high. It is difficult to roll soft strip which would be subject to breaking or other shape problems such as waviness because of the high degree of tension force required. The use of high amounts of tension as would be required by Franek et al. could create internal defects in the strip and any strip with edge cracking tendencies or which would be notch brittle would be difficult to roll. Further, the apparatus is complicated by the necessity of a stabilizing means such as a stabilizing roll.

These difficulties which arise from the necessity of using high amounts of tension in the process are also shared by many of the other non-conventional rolling techniques described above. It has been found desirable to provide a rolling mill which can process metal strip with high percentages of reduction in thickness between anneals without the deficiencies of the prior art. In order to achieve large bites in the nip of rolls, it is desired to utilize small diameter rolls. However, the diameter and arrangement of the rolls should not be so small as to make it difficult to lubricate and cool the mill. Further, it is desired in accordance with this invention to provide a mill which is less complicated than most of those described above.

It has been conventional in the rolling mill art wherein gage reduction is a function of work roll speed ratios that the work rolls are pressed against the strip without the interposition of fixed gap spacing devices. The work rolls thereby achieve an equilibrium spacing in accordance with the various parameters of the rolling process so that the output gage is a function of the ratio of the work roll speeds. In more conventional rolling mill systems, as for example that illustrated in U.S. Pat. No. 4,167,107 to Simmonds, it has been conventional to fix the spacing between the work rolls by providing a means for holding the work rolls in a locked position such as by the clamping devices as illustrated in that patent.

It is also known in the rolling art that improved finish and structure can be obtained by making the last reduction in any pass schedule the lightest or smallest reduction. When multi-stand tandem mills such as a three-stand tandem mill are set up for rolling, they are usually arranged to accomplish the smallest reduction in the pass through the last stand.

SUMMARY OF THE INVENTION

In accordance with our prior U.S. application, Ser. No. 25,232, a cooperative rolling process and apparatus is provided for rolling metal strip by non-symmetrical plastic flow. Unusually high rolling reductions per pass and total rolling reductions between anneals are achieved within the confines of a modified four high rolling mill. The cooperative rolling approach makes maximum utilization of the deformation ability of metallic strip by optimization of roll compression and stretch elongation to derive maximum ductility.

The unusual results in accordance with cooperative rolling are obtained by modifying a standard four high rolling mill although various other configurations are possible. The modification of the rolling mill involves primarily changing the drive mechanism in order to assure that the mill is driven by the back-up rolls and to provide some means by which the back-up rolls can be driven at different speeds. The mill is then strung up or threaded so that the incoming strip is wrapped around the slower moving driven back-up roll and then forms an "S" shape bridle around free wheeling, substantially smaller diameter, work rolls. Finally, it exits the mill by encompassing the fast moving driven back-up roll.

When this is done and the cooperative rolling mill is powered and put under appropriate pressure by a screw down mechanism, three reductions are obtained. The first reduction point is between the first driven slow roll and its adjacent first free wheeling work roll. The second reduction is taken between the two work rolls and the third reduction which is similar to the first reduction is taken between the second work roll and the second back-up roll. This cooperative rolling approach results in three rolling reductions being accomplished in one pass of the strip through the mill.

The mechanisms which govern the reduction at each of the bites of the cooperative rolling mill tend towards reducing the separating force required for rolling. Forward and back tension for the process is provided by wrapping the metal strip around the driven back-up rolls in such a way so as to provide shear drag on the workpiece. The strip is also tensioned as it enters and leaves the mill by conventional means.

In the cooperative rolling process and apparatus, the gap at each roll bite between the respective rolls is not fixed. In operation an equilibrium gap spacing at each roll bite is generated based upon rolling parameters including separating force and friction. It has been found that the percentage reduction in a pass through the mill which occurs at each of the respective roll bites varies depending on the state of the material being rolled. In the first roll bite the percentage reduction which occurs when the material is soft is much greater than the percentage reduction which occurs in subsequent passes as the material becomes work hardened. The percentage reduction for the second roll bite is not affected as significantly. The third roll bite is affected generally in an opposite manner to the first roll bite; namely, it provides a relatively smaller reduction for soft materials and a relatively greater reduction as the material work hardens. These results, which are obtained with the cooperative rolling process and apparatus when the roll gaps are unconstrained, are suitable and indeed desirable for many applications. However, it is often desired to control the crystalline structure, finish and surface structure required after the last reduction in any pass.

It is desirable in many cases that the last reduction in the cooperative rolling mill should be the smallest reduction. Further, if the last reduction is the smallest, the total tension on the strip at this point is reduced and its effect on coil straightness and camber will be favorably improved.

Therefore, in accordance with the present invention, a rolling apparatus and process is provided, preferably of the cooperative type, wherein at least one of the roll gaps in the mill is fixed and wherein at least one of the roll gaps in the mill is left floating. By this arrangement it is possible to alter the equilibrium gap spacings as above described so that a greater percentage reduction is taken in the first roll bite and a small percentage reduction is taken in the final roll bite.

Accordingly, it is an object of this invention to provide an improved process and apparatus for rolling metal strip.

It is a further object of this invention to provide a process and apparatus as above which is capable of providing non-symmetrical plastic flow.

It is a further object of this invention to provide a process and apparatus as above wherein the rolling reduction in the last bite in a pass through the mill is controlled in a non-equilibrium manner.

These and other objects will become more apparent from the following description and drawings.

DETAILED DESCRIPTION OF PREFERRED EMBODIMENTS

In accordance with this invention a rolling process and apparatus is provided, preferably of the cooperative type. The rolling system optimizes bi-axial forces to maximize rolling reduction through a process of non-symmetrical plastic flow. It is applicable to any desired metal or alloy which can be plastically deformed. It is particularly adapted for processing metal strip. Unusually high rolling reductions per pass and total rolling reductions between anneals with excellent surface finish and microstructure can be achieved through the use of a four high rolling mill modified in accordance with this invention. The approach of this invention makes maximum utilization of the deformation ability of the metallic strip by optimization of roll compression and stretch elongation to derive maximum ductility.

The modification of the rolling mill involves primarily changing the drive mechanism so that the mill is back-up roll driven, the provision of some means for driving the back-up rolls at respectively different speeds one from the other, and the fixing of at least one but not all of the roll gaps.

Figure 1:
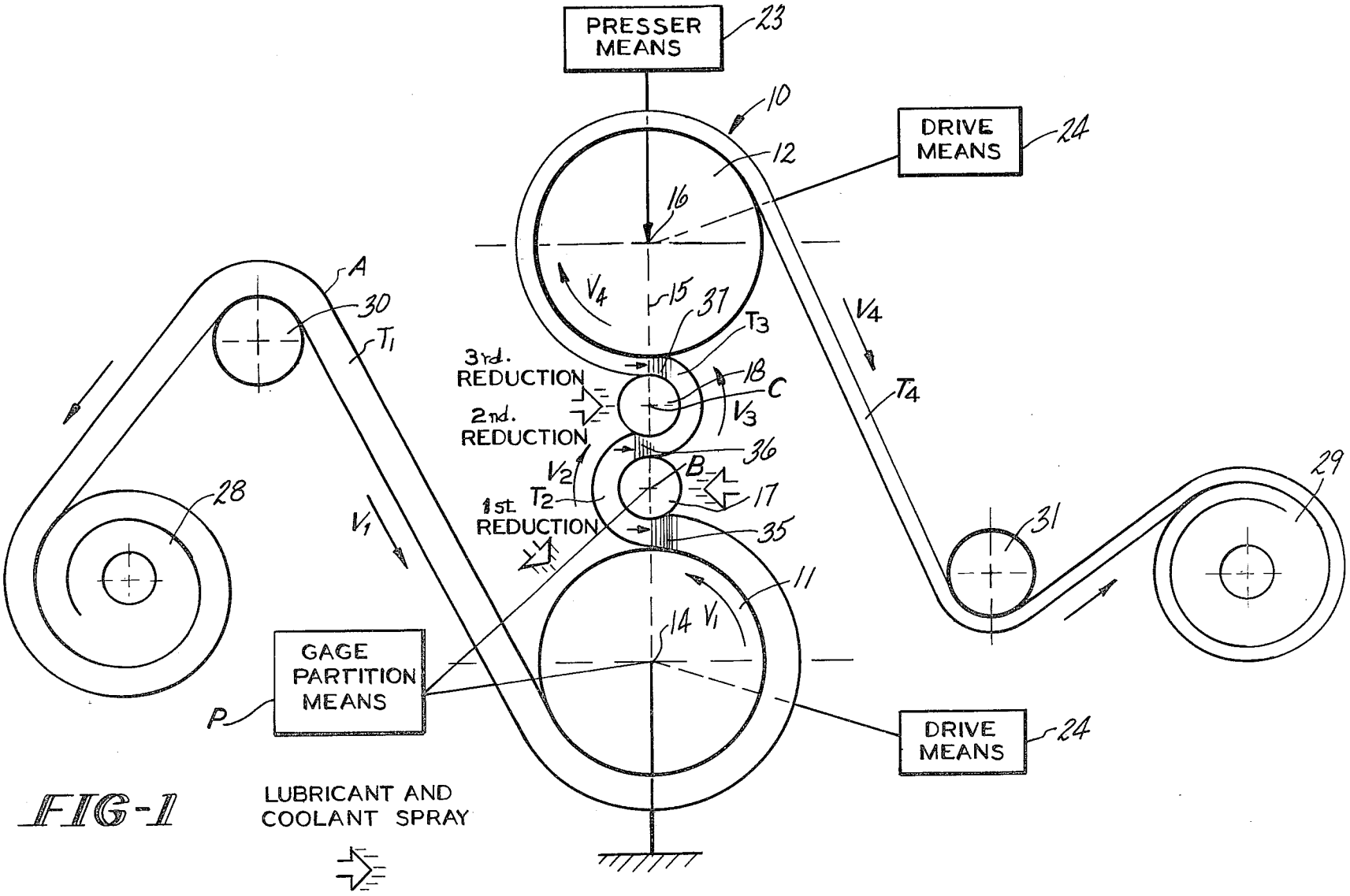
FIG. 1 is a schematic illustration of a side view of an apparatus in accordance with an embodiment of this invention.
Figure 3:
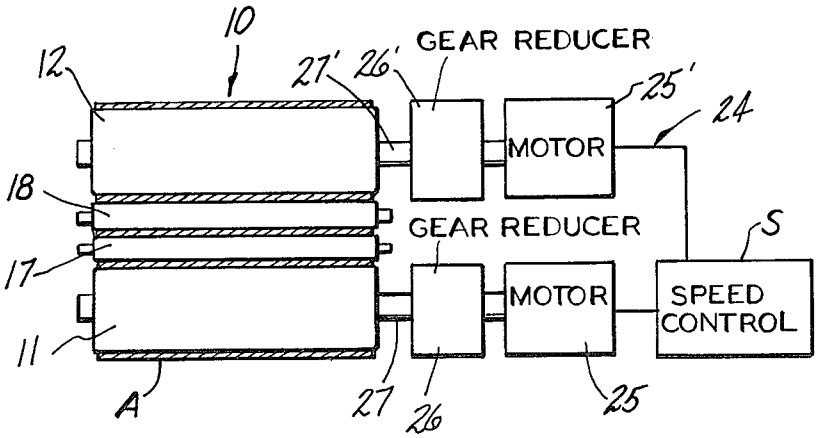
FIG. 3 is a partial view showing the drives to the rolls of the apparatus of FIG. 1.
Figure 2:
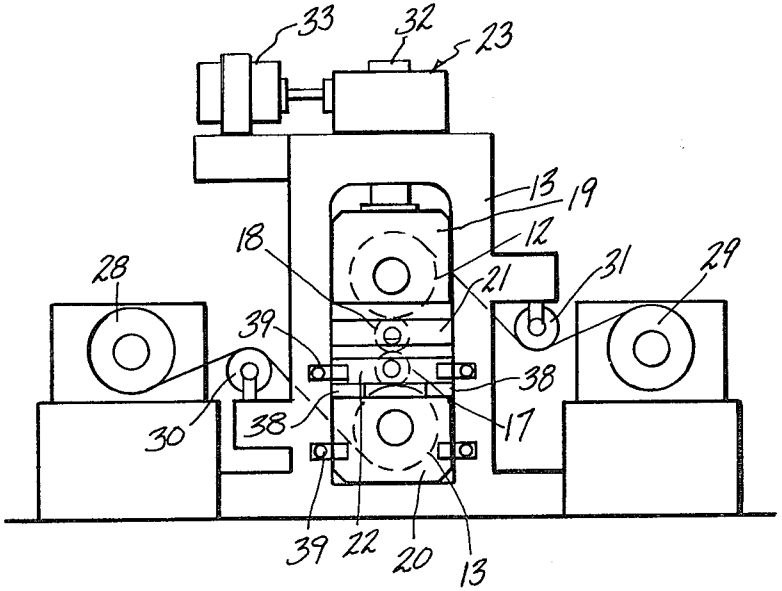
FIG. 2 is a more detailed illustration of the apparatus of FIG. 1.

Referring now to FIGS. 1–3, there is shown by way of example an cooperative rolling mill 10 in accordance with a preferred embodiment of the present invention. The cooperative rolling mill 10 comprises first 11 and second 12 back-up rolls of relatively large diameter. The lower back-up roll 11 is journaled for rotation in the machine frame 13 of the rolling mill 10 about a fixed horizontal roll axis 14. The upper back-up roll 12 is journaled for rotation in the machine frame 13 about roll axis 16 and is arranged for relative movement toward and away from the lower back-up roll 11 along the vertical plane 15 defined by the back-up roll axes 14 and 16. Arranged between the upper 12 and lower 11 back-up rolls are two free wheeling work rolls 17 and 18 having a diameter substantially smaller than the diameter of the back-up rolls 11 and 12. The work rolls 17 and 18 are journaled for rotation and arranged to idle in the machine frame 13. They are adapted to float in a vertical direction along the plane 15. The specific support mechanisms 19, 20, 21, and 22, etc., for the respective rolls 11, 12, 17 and 18 of the mill 10 may have any desired structure in accordance with conventional practice as amply illustrated in the various patents cited in the aforenoted Background of the Invention.

A motor driven screw down presser means 23 of conventional design is utilized to provide a desired compressive force between the back-up rolls 11 and 12 and their cooperating work rolls 17 and 18 and between the work rolls themselves. The arrangement discussed thus far is in most respects similar to the arrangement of a conventional four high rolling mill.

In accordance with this invention, a conventional mill is modified by changing the speed relationship between the lower back-up roll 11 and the upper back-up roll 12 such that the peripheral speed of the lower back-up roll $V_1$ is less than the peripheral speed $V_4$ of the upper back-up roll 12. This can be accomplished relatively easily by a two motor drive 24 as in FIG. 3 which will drive the upper back-up roll 12 at a higher speed relative to the lower back-up roll 11 in proportion to the desired reduction in thickness of the strip A passing through the mill. The back-up rolls 11 and 12 are driven by motors 25 and 25' which are connected to the rolls 11 and 12 through reduction gear boxes 26 and 26' and drive spindles 27 and 27'. A speed control S is connected to the motors 25 and 25' in order to drive the rolls 11 and 12 at the desired speed ratio. The particular drive system 24 which has been described above does not form part of the present invention, and any desired drive system for driving the rolls 11 and 12 at the desired peripheral speed ratio could be employed. A two motor drive system similar to that described above for example is shown in U.S. Pat. No. 3,332,292 to Roberts. The drive to the work rolls 17 and 18 is provided by the back-up rolls 11 and 12 acting through the encompassing strip A.

In a conventional four high rolling mill a single rolling bite would be taken in the strip A as it passed through the nip between the work rolls. This is also the approach used by Vydrin et al. in reference to FIG. 6 of their '017 patent.

In accordance with this preferred embodiment, the strip A is strung or threaded as shown in FIG. 1 whereby the incoming strip is wrapped around the slower moving back-up roll 11 and then forms an "S" shaped bridle around the work rolls 17 and 18 and finally exits by encompassing the fast moving back-up roll 12. In this manner three reductions as shown in FIG. 1 are taken in the strip A as it passes through the mill 10. The first reduction is between the slow moving lower back-up roll 11 and its cooperating lower work roll 17. The second reduction is between the lower and upper work rolls 17 and 18. The third reduction is between the upper work roll 18 and its cooperating fast moving upper back-up roll 12. Front and back tensions $T_1$ and $T_4$ are applied to the strip A in a conventional manner by any desired means such as the coiler/decoilers 28 and 29. Billy rolls 30 and 31 arranged as shown are used to redirect strip A direction to provide the desired wrapping about the back-up rolls 11 and 12.

The strip A encompasses each of the work rolls 17 and 18 through about 180° of the circumference of the rolls. In the embodiment shown, the strip A encompasses each of the back-up rolls 11 and 12 to a greater extent, namely, about 270°. Since the strip A only encompasses the work rolls through about 180°, it is relatively easy to apply coolant and lubricant as shown in FIG. 1. The specific apparatus for applying the coolant and lubricant may be of any desired conventional design as are known in the art. The large size of the back-up rolls 11 and 12 also allows for relatively easy application of coolant and lubricant as shown even with a high degree of wrap.

In operation of a cooperative rolling mill, the strip A is threaded through the mill 10 in the manner shown in FIG. 1, and suitable back and forward tensions $T_1$ and $T_4$ are applied to the leading and trailing portions of the strip A by means of the coiler/decoilers 28 and 29. The presser means 23 which may be of any conventional design and which may be hydraulically actuated (not shown) or screw 32 actuated through a suitable motor drive 33 is operated to apply a desired and essential operating pressure or compressive force between the respective rolls 11, 12, 17, and 18. The tension $T_1$ and $T_4$ applied to the strip A preferably should be sufficient to prevent slippage between the rolls 11, 12, 17, and 18 and the strip A. The motor 25 is energized to advance the strip A through the mill 10 by imparting drive to the back-up rolls 11 and 12 which in turn drive the idling work rolls 17 and 18 through the strip A. The upper back-up roll 12 and the work rolls 17 and 18 are arranged for floating movement vertically along the plane 15. In the preferred embodiment the roll axes 14, 16, B or C of each of the back-up rolls 11 and 12 and work rolls 17 and 18 all lie in the single vertical plane 15 as shown. If desired, however, to attain greater stability for the work rolls 17 and 18, the plane defined by the axes B and C of the work rolls 17 and 18 can be tilted very slightly with respect to the plane 15 defined by the axes 14 and 16 of the back-up rolls 11 and 12 so that the angle defined between the plane of the work rolls 17 and 18 and the plane 15 of the back-up rolls 11 and 12 is less than about 10° and preferably less than about 5°. The plane of the work rolls 17 and 18, if tilted at all, should preferably be tilted in a direction to further deflect the strip A, namely, clockwise as viewed in FIG. 1.

However, it may not be essential in accordance with this invention that the plane of the work rolls 17 and 18 be tilted with respect to the plane 15 of the back-up rolls 11 and 12 and such an expedient should only be employed in the event that it is necessary to provide stabilization of the work rolls 17 and 18. Alternatively, it is possible though not desirable to stabilize the work rolls 17 and 18 by the use of a stabilizing roller engaging the free surface of the work rolls 17 and 18 which in FIG. 1 is the surface to which the coolant and lubricant is directed. Such an approach would inhibit the application of coolant and lubricant.

In any event if it is desired to tilt the plane of the work rolls 17 and 18 relative to the plane 15 of the back-up rolls 11 and 12, the degree of tilt should be kept within the aforenoted ranges and should not be so great as to prevent the application of pressure by means 23 to the three roll bites.

It is preferred in accordance with this invention that the pressure means 23 be adapted to apply the pressure to the respective rolls 11, 12, 17, and 18 rather than generating such pressure between the respective rolls solely by means of the tension applied to the strip as in the Franek et al. apparatus.

When the mill 10 is powered up and put under reasonable separating force by the presser means 23, the three reduction points are attained as shown in FIG. 1.

In Table I the partitioning of the thickness reductions in a cooperative rolling mill operated in its usual manner is exemplified for a series of five passes through the mill of type 403 stainless steel which initially was in the annealed condition and had a gage of 0.020". The reduction in thickness per pass through the mill was fixed at 20% by appropriately controlling the ratio of the input back-up roll 12 and output back-up roll 11 peripheral speeds.

TABLE I

GAGE PARTITIONING IN COOPERATIVE ROLLING

| | | First Reduction | | Second Reduction | | Third Reduction | | |
|---|---|---|---|---|---|---|---|---|
| Pass No. | Starting Gage, Inches | Reduction in Thickness, Inches | Percentage of Total Reduction per Pass | Reduction in Thickness, Inches | Percentage of Total Reduction per Pass | Reduction in Thickness, Inches | Percentage of Total Reduction per Pass | Total Reduction per Pass, Inches |
| 1 | 0.020 | 0.0018 | 47 | 0.0013 | 34 | 0.0007 | 18 | 0.0038 |
| 2 | 0.0162 | 0.00065 | 19 | 0.0016 | 49 | 0.001 | 31 | 0.00325 |
| 3 | 0.01295 | 0.00045 | 16 | 0.0015 | 56 | 0.00075 | 28 | 0.0027 |
| 4 | 0.01025 | 0.0002 | 10 | 0.0012 | 63 | 0.0005 | 26 | 0.0019 |
| 5 | 0.00635 | 0.0001 | 6 | 0.00095 | 58 | 0.0006 | 36 | 0.00165 |

It is apparant from a consideration of Table I that the partition of the total reduction per pass between the first, second, and third roll bites 35, 36, and 37 varies as the material being rolled is work hardened. The initially relatively soft annealed material in its first pass through the mill is subjected to almost 50% of the total reduction in thickness in the first roll bite 35, just under 35% in the second roll bite 36, and just under 20% in the third roll bite 37. However, in the second and further passes, the percentage of total per pass reduction taken by the first roll bite 35 decreases substantially to less than 20%, the second roll bite 36 increases to over 50%, and the third roll bite 37 increases to the neighborhood of 30%.

Therefore, when a cooperative rolling mill is operated in its equilibrium mode wherein each of the roll bites 35, 36, and 37 between the rolls 11, 12, 17, and 18 of the mill 10 are free floating, the final reduction in the mill can vary from low levels for soft materials to relatively high levels as the materials are work hardened.

It has been found desirable in the rolling art that the last reduction in thickness of a strip material be a relatively light or small reduction so as to provide optimum surface finish and microstructure as well as to reduce camber and improve coil straightness. It is apparent from a consideration of Table I that when a cooperative rolling mill or other type mill having a floating roll bite and at least one idling bite roll is operated in an equilibrium mode the final reduction in each pass through the mill depends on the work hardness of the material being rolled. This final reduction can be quite substantial and much greater than desired in some cases for a final reduction.

Therefore, in accordance with this invention, a gage partitioning means P is provided wherein at least one, but not all, of the roll gaps defined by the roll bites 35, 36, and 37 in the mill 10 are fixed. This can bias the first, second, and third reductions in a pass through the mill 10 so that the final reduction (third reduction) is controlled to a desired level for a finish reduction. Preferably, the third reduction in thickness is controlled so as to be less than about 25% of the total reduction in thickness of the material per pass and preferably less than about 20% of the total reduction per pass.

The gage partitioning means P comprises a system for fixing one or more of the roll gaps 35–37 in the mill 10. Any desired conventional approach for fixing the roll gaps (bites) could be employed, as for example, clamping devices described in U.S. Pat. No. 4,167,107 to Simmonds noted in the Background of this application. It is an essential aspect of the present invention that not all of the roll gaps 35–37 in the mill 10 are fixed. At least one gap 35–37 must be left floating so that it can adjust to the reduction in thickness necessary to maintain the reduction ratio of the mill 10 in accordance with the differential peripheral speed ratio of the input and output rolls 11 and 12.

In the preferred embodiment, which is set forth in FIG. 2, the gage partitioning means P comprises spacer blocks 38 which are located at both sides and between the lower back-up roll carriage 20 and the lower work roll carriage 22. These carriages 20 and 22 are locked in place by clamps 39 so that they are not free to move during operation of the mill 10. The upper work roll carriage 21 and the upper back-up roll carriage 19 are left to float under the applied pressure of the presser means 23.

It is believed in accordance with this invention that the fixing of the first roll bite 35 gap spacing in the manner described will serve to bias the percentage of the total reduction in a pass through the mill in a desired manner. This assumes that the percentage of total reduction per pass in the roll bite 35 is selected as fixed to provide a value other than the normal equilibrium value which would be achieved if it were left free floating. For example, if it is desired as indicated above to provide a final reduction after multiple passes which is a light reduction, then the spacer blocks 38 would be selected to provide in the first reduction approximately 30% of the total reduction in a pass through the mill 10. It is believed that the second reduction which would not be fixed would run from approximately 50 to 60% of the total per pass reduction and that the final reduction which would not be fixed would run approximately in excess of 10% but less than 20% of the total per pass reduction. In this manner, the locking of the first roll bite 35 to provide a desired percentage of the total reduction per pass serves to bias the amount of reduction at each roll bite 35–37 so that the final reduction is relatively light.

Obviously, various other arrangements are possible whereby the reductions in the first 35, second 36, and third 37 roll bites can be biased by selective fixing some, but not all, of the roll gaps.

In the preferred embodiment as described above, at least the roll gap defined at the first roll bite 35 is fixed. However, if desired to achieve a given partitioning of the reductions in the three roll bites 35–37 of the mill 10 shown, any desired roll bite 35–37 could be fixed as long as one is left floating.

The arrangement illustrated in FIG. 2 employs separator blocks 38 and clamps 39 for fixing the first roll gap 35. The clamping devices 39 may be of any conventional arrangement and are merely shown schematically. For example, carriage clamping systems are clearly illustrated in the aforenoted Simmonds patent.

Figure 4:
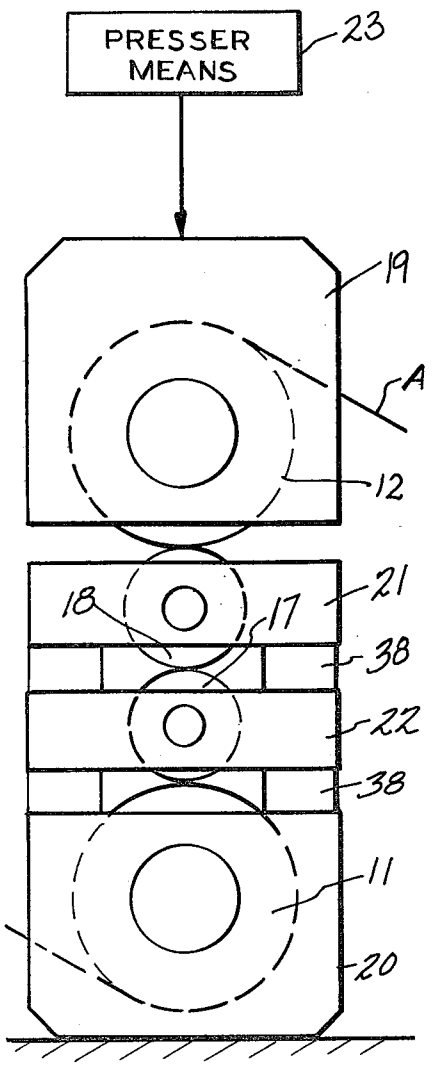
FIG. 4 is a partial schematic illustration of an apparatus in accordance with this invention, including one embodiment of a fixed gap roll spacing arrangement.

In the mill of FIG. 2, only one of the roll gaps 35–37 is fixed by means of the spacer blocks 38 and clamps 39, one spacer block being provided at each side of the carriages 20 and 21. Referring now to FIG. 4, an alternative embodiment is exemplified wherein only the carriages 19–22 and rolls 11, 12, 17, and 18 from the mill 10 of FIG. 2 are illustrated. In this embodiment both the first and second roll bites 35 and 36 are fixed by means of spacer blocks 38. Each of the lower back-up roll 20, lower work roll 22, and upper work roll 21 carriages would be locked in place by clamps (not shown) to provide the fixed gaps 35 and 36 as established by the spacer blocks 38 in a manner as described in reference to FIG. 2. In the embodiment of FIG. 4, the reduction which would be achieved in the first and second roll bites 35 and 36 would be limited or controlled by the fixed gap spacings of the respective rolls 11, 17, and 18. The reduction in the third roll bite 37 would float to provide the necessary value to provide the overall total reduction in accordance with the ratio of the back-up rolls 11 and 12 peripheral speeds.

Figure 5:
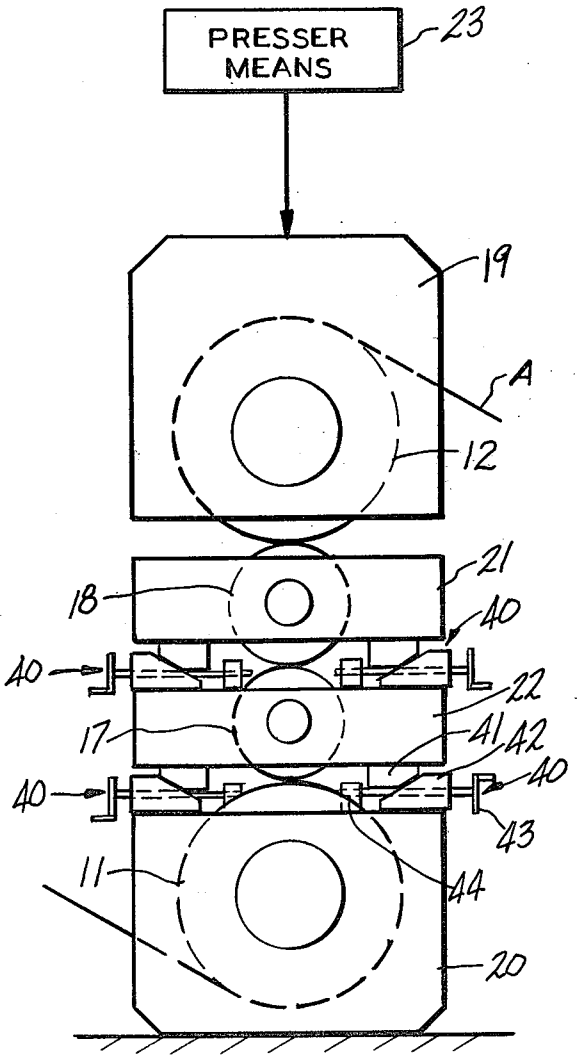
FIG. 5 is a schematic illustration of an apparatus in accordance with this invention including another embodiment of a fixed gap roll spacing arrangement.

FIG. 5 is illustrative of an alternative arrangement for fixing the roll gaps 35 and 36. In accordance with FIG. 5 instead of using fixed dimension spacer blocks 38, an adjustable inclined plane arrangement 40 is provided. In this arrangement an upper inclined member 41 is fixed to the work roll carriage 21 or 22 at each side of the carriage. A lower inclined member 42 is slidably supported on the top surface of the lower back-up roll 22 and work roll 20 carriages. A lead screw and crank 43 is journaled in a frame member 44 fixed to the lower work roll 22 and back-up roll 20 carriages and is threadingly engaged to the sliding inclined member 42. As the crank 43 is turned, the inclined member 42 is moved laterally either toward or away from the rolls 11, 17, and 18. As the sliding inclined block 42 moves toward the rolls 11, 17, or 18, the gap spacing at roll bites 35 or 36 is increased and vice versa. In this manner it is possible to provide adjustable gap spacings for the roll gaps 35 and 36 which are to be fixed. After the desired roll gap spacing is set in the adjustable manner above described, the carriages 20, 21, and 22 would be locked in place by clamps (not shown) as in accordance with the previous embodiments of FIG. 2.

Figure 6:
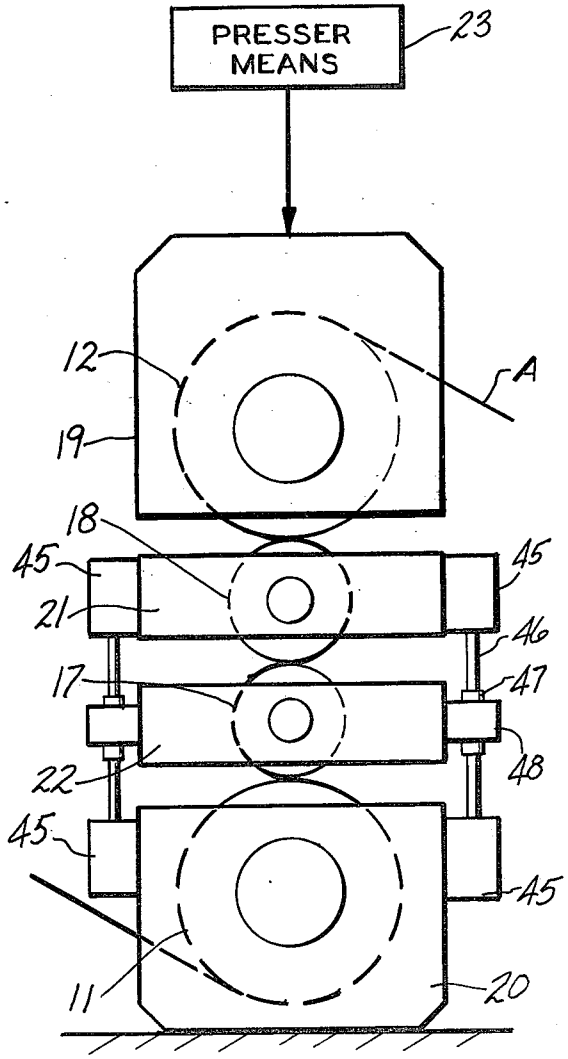
FIG. 6 is a schematic illustration of an apparatus in accordance with this invention including yet another embodiment of a fixed gap roll spacing arrangement.

Referring now to FIG. 6, yet another alternative arrangement of a gage partitioning means P is shown. In this arrangement hydraulic cylinders 45 are supported by the lower back-up roll carriage 20 and the upper work roll carriage 21. The cylinder piston rods 46 are connected to anvils 47 which engage an extended frame portion 48 of the lower work roll carriage 22. By adjusting the extension of the anvils 47 relative to the cylinders 45, it is possible to adjust the roll gaps 35 and 36 between the respective rolls 11, 17, and 18. When the desired roll gap spacings are obtained, the carriages 20, 21, and 22 would be locked in place by clamps 39 in the manner previously described. Alternatively, the hydraulic pressures could be fixed and the gap spacings maintained hydraulically.

It is apparent then in accordance with the present invention that through the use of gage partitioning means P comprising fixed gap separators 38, 40, 45, etc. for at least one, but less than all, of the roll gaps 35, 36, and 37 in a cooperative rolling mill 10, it is possible to partition the reductions at the various roll gaps 35, 36, and 37 in a manner suitable to a desired end product.

As above described, the total reduction in thickness in any pass through a cooperative rolling mill 10 is generally equal to the difference in peripheral rotational speeds between the entry and exit drive rolls 11 and 12. The fixed gap separators 38, 40, 45, etc. of the gage partitioning means P it is believed can be utilized to maximize or limit any of the reductions in the mill 10 which occur at the various roll bites 35, 36, and 37.

In the cooperative rolling process of the present invention utilizing the apparatus 10 described results in three rolling reductions being accomplished in one pass of the strip A through the mill 10 by active mechanisms which all tend towards reducing the separating force for rolling. As shown in FIG. 1, it is believed that the forward and back tensions $T_2$ and $T_3$ in the reduction zones for this process are principally provided by the wrapping of the strip A around the driven back-up rolls 11 and 12 in such a way as to provide shear drag on the strip. Since the workpiece or strip A encompasses the slower large driven roll 11, little or no slipping should occur around the periphery of this roll 11 because of the back tension $T_1$ provided by the coiler/decoiler 28 and the shear drag of the roll itself. A similar situation exists for the upper back-up roll 12 because of the forward tension $T_4$ and the shear drag of this roll. The driven uppermost large back-up roll 12 should be driven at a peripheral speed consistent with the final desired gage of the strip A. Accordingly, it will be rotating at a peripheral speed $V_4$ relative to the speed $V_1$ of the lower back-up roll 11 which is proportional to the total reduction which is to be done in the roll stand 10.

The ratio between the diameters of the back-up rolls 11 and 12 and the diameters of the work rolls 17 and 18 should in accordance with this invention preferably range from about 2:1 to 9:1 and most preferably from about 3:1 to 8:1. This results in a distinct difference in the diameters of the respective work 17 and 18 and back-up rolls 11 and 12. However, the difference in diameters need not be as drastic as required in accordance with some prior art apparatuses. The apparatus as shown in FIG. 1 is adapted to lower the separating forces preferably by a minimum of 2:1 as compared to a conventional four high mill.

The amount of wrap of the strip about the driven back-up rolls 11 and 12 depends on the friction and lubricity conditions between the strip A and the respective back-up roll 11 or 12 and may be set as desired to assure minimization of any slippage which might occur between the strip A and the rolls. The total force or pressure between the top and bottom back-up rolls 11 and 12 is positive and less than that required for conventional rolling. Since the gage of the resulting strip A is determined by the relative peripheral speed ratio between the upper and lower back-up rolls 11 and 12, the apparatus 10 is generally insensitive to the pressure applied by the presser means 23 over a reasonable range of pressure.

While in the examples a 20% reduction per pass was employed, greater percentage reductions per pass could be employed if desired. It is believed that the process of this invention is capable of achieving at least a 35% reduction per pass. While it is possible in accordance with this invention to carry out the rolling with the same percentage reduction per pass as demonstrated, any desired pass schedule could be employed.

The invention is believed to be widely applicable to any metal or alloy susceptible of plastic deformation including, but not limited to, iron and iron alloys, copper and copper alloys, nickel and nickel alloys, and aluminum and aluminum alloys.

While a vertical arrangement of the roll stack has been shown, they can be arranged horizontally or otherwise as desired. It has been found possible in practice to operate the aforenoted mill 10 without the use of bridle rolls so that the tensions $T_1$ and $T_4$ are provided by the coiler/decoilers 28 and 29. However, if desired, bridle rolls or other suitable means could be employed to provide those tensions.

The term "generally in a plane" as used in reference to the arrangement of the various roll axes 14, 16, B, and C is intended to include any slight tilting of the plane of the work roll axes B and C relative to the plane 15 of the back-up roll axes 14 and 16 in accordance with this invention.

In accordance with the present invention, it is possible to employ a substantial number of passes through the mill without so increasing the separating force so as to render the mill inoperative for further reduction and require an anneal. Further, the separating force generated by the process and apparatus of this invention is considerably lower than would be expected for a conventional rolling mill. The process and apparatus in accordance with this invention is limited only by the ability of the strip to absorb plastic deformation.

The patents and article set forth in the Background of this application are intended to be incorporated by reference herein.

It is apparent that there has been provided in accordance with this invention a cooperative rolling process and apparatus which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A rolling mill comprising a plurality of rolls, said rolls defining a plurality of roll bites for reducing the thickness of a material being rolled, each of said roll bites defining a gap spacing between adjacent rolls;

means for driving a first and a second of said rolls at a desired peripheral speed ratio corresponding to a desired reduction in thickness of said material in a pass of said material through said mill;

at least one idling work roll arranged intermediate said first and second rolls;

means for providing a gap spacing which is fixed for at least one of said roll bites; and means for providing a gap spacing which is not fixed for at least one other of said roll bites;

whereby it is possible to control in a desired manner the amount of thickness reduction of said material which occurs in at least one of said roll bites in a pass of said material through said mill.

2. A mill as in claim 1 wherein said rolls are arranged generally in a plane.

3. A mill as in claim 1 wherein said means for providing a gap spacing which is not fixed comprises means for supporting said first roll, said second roll and said at least one work roll for relative movement toward and away from each other.

4. A mill as in claim 1 wherein said means for providing a gap spacing which is not fixed comprises means for providing a floating roll bite which adjusts in operation to the reduction in thickness necessary to maintain said desired reduction in thickness of said material in said pass through said mill.

5. A mill as in claim 1 wherein said means for providing a fixed gap spacing comprises means for spacing apart said adjacent rolls defining said gap spacing at said at least one roll bite to provide a desired gap spacing between them and means for locking said adjacent rolls in position so as to maintain said desired gap spacing fixed.

6. A mill as in claim 5 wherein said means for providing a gap spacing which is not fixed comprises means for providing a floating roll bite which adjusts in operation to the reduction in thickness necessary to maintain said desired reduction in thickness of said material in said pass through said mill.

7. A mill as in claim 6 wherein said means for providing a gap spacing which is not fixed comprises means for supporting said first roll, said second roll and said at least one work roll for relative movement toward and away from each other.

8. A mill as in claim 1 wherein said first and second rolls comprise back-up rolls having respective first and second roll axes defining a first plane, said back-up rolls being arranged for relative movement generally in said first plane toward and away from each other; and wherein at least one other idling work roll is provided so that said at least one work roll and said at least one other work roll have respective third and fourth roll axes arranged generally in said first plane, said work rolls being arranged between said first and second back-up rolls and said work rolls being arranged for relative movement generally in said first plane toward and away from said back-up rolls and for each other, said work rolls having substantially smaller diameters than said back-up rolls;

said rolls being arranged to take at least three thickness reductions in said material in a single pass through said mill;

said rolls being arranged so that said material travels through said mill in a serpentine fashion wherein said material first encompasses said first back-up roll and then forms an S-shape bridle about said work rolls and then encompasses said second back-up roll;

said mill further including means for applying forward and back tension to said material as it passes through said mill; and presser means for applying a desired pressure between said rolls.

9. A mill as in claim 8 wherein a ratio of the diameters of said first or second back-up rolls to said first or second work rolls is from about 2:1 to about 9:1.

10. A mill as in claim 9 wherein said ratio is from about 3:1 to about 8:1.

11. A mill as in claim 8 wherein said third and fourth axes of said work rolls define a second plane and wherein said second plane of said work rolls is tilted relative to said first plane of said back-up rolls in an amount less than about 10° and in a direction into said strip.

12. A mill as in claim 11 wherein said second plane of said work rolls is tilted relative to said first plane of said back-up rolls less than about 5°.

13. A mill as in claim 2 wherein said plane of said rolls is arranged generally vertically.

14. A mill as in claim 8 wherein said strip encompasses said first and second back-up rolls over a sufficient portion of the circumference thereof to prevent slippage between said strip and said back-up rolls.

15. A mill as in claim 8 wherein said means for providing a gap spacing which is not fixed comprises means for providing a floating roll bite which adjusts in operation to the reduction in thickness necessary to maintain said desired reduction in thickness of said material in said pass through said mill.

16. A mill as in claim 8 wherein said means for providing a fixed gap spacing comprises means for spacing apart said adjacent rolls defining said gap spacing at said at least one roll bite to provide a desired gap spacing between them and means for locking said adjacent rolls in position so as to maintain said desired gap spacing fixed.

17. A mill as in claim 8 wherein said fixed gap spacing is defined by said roll bite arranged to provide a first of said at least three thickness reductions, whereby it is possible to control a portion of the total reduction of said material in a pass through said mill which occurs in said roll bite providing a last of said thickness reductions in said material.

18. A mill as in claim 17 wherein the magnitude of said fixed gap spacing is selected so that said last reduction in said material comprises less than about 25% of said total reduction of said material in a pass through said mill.

19. A mill as in claim 1 wherein said material comprises metal strip.

20. A process for rolling a material for reducing its thickness, said process comprising providing a rolling mill comprising a plurality of rolls, said rolls defining a plurality of roll bites for reducing the thickness of said material being rolled, each of said roll bites defining a gap spacing between adjacent rolls;

driving a first and a second of said rolls at a desired peripheral speed ratio corresponding to a desired reduction in thickness of said material in a pass of said material through said mill;

providing at least one idling work roll arranged intermediate said first and second rolls;

fixing a gap spacing for at least one of said roll bites;

providing a gap spacing which is not fixed for at least one other of said roll bites;

whereby it is possible to control in a desired manner the amount of thickness reduction of said material which occurs in at least one of said roll bites in a pass of said material through said mill.

21. A process as in claim 20 further including arranging said rolls generally in a plane.

22. A process as in claim 20 wherein said step of providing a gap spacing which is not fixed comprises supporting said first roll, said second roll and said at least one work roll for relative movement toward and away from each other.

23. A process as in claim 20 wherein said step of providing a gap spacing which is not fixed comprises providing a floating roll bite and adjusting said floating roll bite in operation to the reduction in thickness necessary to maintain said desired reduction in thickness of said material in said pass through said mill.

24. A process as in claim 20 wherein said step of fixing said gap spacing comprises spacing apart said adjacent rolls defining said gap spacing at said at least one roll bite to provide a desired gap spacing between them and locking said adjacent rolls in position so as to maintain said desired gap spacing.

25. A process as in claim 20 wherein said material comprises metal strip and wherein said first and second rolls comprise back-up rolls having respective first and second roll axes defining a first plane, said back-up rolls being arranged for relative movement generally in said first plane toward and away from each other; and providing at least one other idling work roll so that said at least one work roll and said at least one other work roll have respective third and fourth roll axes arranged generally in said first plane, said work rolls being arranged between said first and second back-up rolls and said work rolls being arranged for relative movement generally in said first plane toward and away from said back-up rolls and from each other, said work rolls having substantially smaller diameters than said back-up rolls;

taking at least three thickness reductions in said strip in a single pass through said mill;

passing said strip through said rolls in a serpentine fashion wherein said strip first encompasses said first back-up roll and then forms an S-shape bridle about said work rolls and then encompasses said second back-up roll;

applying forward and back tension to said strip as it passes through said rolls; and applying a desired pressure between said rolls.

26. A process as in claim 25 further including the step of selecting said rolls such that the ratio of diameters of said first or second back-up rolls to said first or second work rolls is from about 2:1 to about 9:1.

27. A process as in claim 26 wherein said ratio is from about 3:1 to about 8:1.

28. A process as in claim 25 wherein said third and fourth axes of said work rolls define a second plane and further including tilting said second plane of said work rolls relative to said first plane of said back-up rolls in an amount less than about 10° and in a direction into said metal strip.

29. A process as in claim 28 wherein said second plane of said work rolls is tilted relative to said first plane of said back-up rolls less than about 5°.

30. A process as in claim 25 wherein said strip is encompassed about a sufficient portion of the circumference of said back-up rolls to prevent slipping between said strip and said back-up rolls.

31. A process as in claim 25 comprising passing said strip through said rolls in a plurality of passes wherein the percent reduction in thickness for each pass of said strip through said rolls is the same.

32. A process as in claim 25 wherein said step of fixing said gap spacing comprises fixing said gap spacing of said roll bite arranged to provide a first of said at least three thickness reductions, whereby it is possible to control a portion of the total reduction of said material in a pass through said mill which occurs in said roll bite providing a last of said thickness reductions in said material.

33. A process as in claim 32 wherein the magnitude of said fixed gap spacing is selected so that said last reduction in said material comprises less than about 25% of said total reduction of said material in a pass through said mill.

* * * * *

UNITED STATES PATENT AND TRADEMARK OFFICE

CERTIFICATE OF CORRECTION

PATENT NO. : 4,329,863

DATED : May 18, 1982

INVENTOR(S) : Michael J. Pryor and Joseph Winter

It is certified that error appears in the above—identified patent and that said Letters Patent is hereby corrected as shown below:

In Column 1, lines 39 & 40, the word "timeconsuming" should read ——time-consuming——.

In Column 5, line 58, the word "an" should read ——a——.

In Column 8, line 41, the word "apparant" should read ——apparent——.

In Column 9, line 65, the word "selective" should read ——selectively——.

In Column 13, line 45, the word "for" should read ——from——.

Signed and Sealed this

*Twenty-sixth* Day of *October 1982*

[SEAL]

*Attest:*

GERALD J. MOSSINGHOFF

*Attesting Officer*

*Commissioner of Patents and Trademarks*